United States Patent [19]

Weaver

[11] 4,216,042

[45] Aug. 5, 1980

[54] METHOD OF MAKING A PREFORMED BATHING VESSEL

[76] Inventor: Albert E. Weaver, 15001 Calvert, Van Nuys, Calif. 91411

[21] Appl. No.: 878,740

[22] Filed: Feb. 17, 1978

[51] Int. Cl.[2] ..... A47K 3/00

[52] U.S. Cl. ..... 156/62.2; 156/245; 156/252; 156/256; 156/293; 156/298; 264/219; 264/269; 427/230; 427/236; 4/584; 4/614

[58] Field of Search ..... 156/62.2, 71, 245, 286, 156/280, 298, 212, 293, 252, 256; 4/173, 187 R, 146, 234, 237, 172, 172.19; 264/259, 257, 267-269, 309, 299, 31, 32, 219; 52/309.1, 309.13, 309.15, 128; 249/83; 427/230, 236; 128/66

[56] References Cited

U.S. PATENT DOCUMENTS

| | | | |
|---|---|---|---|
| 2,119,278 | 5/1938 | Keller | 264/269 |
| 2,660,761 | 12/1953 | Peters | 264/269 |
| 2,695,256 | 11/1954 | DeOlloqui et al. | 4/173 |
| 2,715,280 | 8/1955 | Kish | 264/267 |
| 2,736,065 | 2/1956 | Wilcox | 264/269 |
| 2,784,417 | 3/1957 | Strand | 4/173 |
| 2,893,907 | 7/1959 | Bove | 156/71 |
| 3,091,000 | 5/1963 | Makowski | 264/269 |
| 3,151,341 | 10/1964 | King | 4/173 |
| 3,396,412 | 8/1968 | Francom | 4/173 |
| 3,435,101 | 3/1969 | Boorman | 264/269 |
| 3,703,571 | 12/1972 | Roberts | 264/269 |
| 3,775,214 | 11/1973 | Winters | 156/245 |
| 3,855,027 | 12/1974 | Erdmann et al. | 156/245 |
| 3,893,882 | 7/1975 | Repenning | 264/269 |
| 4,105,734 | 8/1978 | Nakagawa | 156/245 |
| 4,126,719 | 11/1978 | Koyanagi et al. | 156/245 |
| 4,136,147 | 1/1979 | Wheeler | 264/269 |

OTHER PUBLICATIONS

Classification Bulletin of the U.S. Patent Office, Class 264, Plastic and Non-metallic Article Shaping or Treating Processes, Dec. 26, 1963, pp. 1-4.

*Primary Examiner*—Jerome W. Massie
*Attorney, Agent, or Firm*—Seiler & Quirk

[57] ABSTRACT

Custom bathing vessels are preformed away from the job site by constructing a structural plywood shell, and coating the inside of the shell with a fiberglass/resin mixture. The unit is shipped to the job site, where an asphalt-impregnated felt membrane and a surface coating, such as tile, are applied.

9 Claims, 3 Drawing Figures

METHOD OF MAKING A PREFORMED BATHING VESSEL

BACKGROUND OF THE INVENTION

In recent years, the conventional oblong bathtub has undergone revoluntionary design changes. At the present time, commercial tubs are available in many different shapes and depths, and are optionally equipped with hydrotherapy systems that circulate water from the tub through nozzles, or "jets", located in the side walls of the tub. The force and swirling action of the water through the jets impart a soothing and therapeutic effect to the user.

Some bathtubs are manufactured in a factory location and shipped to the job site for installation. These units are made in standard, predetermined sizes, and are usually ordered from sales catalogs. However, with the growing popularity of very large tubs, sometimes referred to as "Roman" tubs, different manufacturing techniques have been required.

Since many of the large bathing vessels hold a ton or more of water, these tubs have been fabricated from waterproofed concrete. The great weight and risk of damage to factory-formed concrete tub shells has rendered prefabrication of these tubs impractical, and it has been necessary to form these tubs on the job site (i.e., in the exact location in the residence or lodging unit where the tube is desired).

For onsite forming of large vessels, a form is first constructed from wood to the desired shape of the vessel, and steel reinforcing bars are placed in the form. Next, the plumbing is set in place in the forms. The concrete is mixed and poured; after the concrete has set, the wood forms are stripped away. Then the inner surface of the concrete is sealed with an asphalt material, and the surface finish (tile, marble, or the like) is set in place.

This construction technique creates a number of difficulties. Firstly, the use of concrete on upper floors in a building imposes an extremely heavy weight load on the building when the tub is full. Therefore, expensive structural changes must be made to accomodate this weight. Though heavy, the concrete wall is nonetheless relatively thin and porous, with the possibility of cracking due to a shift in the building foundation. Plumbing problems or leaks in the concrete shell are difficult to locate and repair, since much of the vessel would have to be hammered away to make the repair.

Possibly the biggest difficulty with the poured-in-place concrete tub is associated with the logistics of the construction operation. Building of the tub, which is a relatively small part of any overall construction project, requires different workers from the carpentry, plumbing, steel, roofing (for asphalt sealing), tile, and electrical trades. Each worker must perform a relatively small function in the construction of the bath; if one worker does not show up on time, all others are delayed. The work is difficult on site because the workers are confined to a relatively small area, and other building activity is also going on in the same area. Therefore, it is desirable to remove as much of the tub construction work as possible away from the job site.

Therefore, it is an object of the invention to provide a base for a large bathing vessel which may be fabricated in a factory. It is another object of the invention to provide a method of manufacturing a bathing vessel which enables the vessel to be easily custom manufactured in a factory location to fit the particular specifications of a job site. It is another object of the invention to provide a custom bathing vessel which is relatively strong and lightweight, but which need not be fabricated from concrete. These and other objects of the invention shall be more fully illustrated in the following detailed description of the invention.

SUMMARY OF THE INVENTION

A base for a bathing tub comprises a structural wood vessel having the interior surface thereof coated with a solid, waterproof fiberglass/resin mixture. A method of manufacturing a bathing vessel comprises constructing a structural base portion in the shape of a vessel from sheet material, and applying to an interior surface of said base portion successively a fiberglass/resin mixture, a waterproofing sealer, and a water-impervious decorative coating.

BRIEF DESCRIPTION OF THE DRAWINGS

The invention is best understood with reference to the drawings, in which.

DETAILED DESCRIPTION OF THE INVENTION

Figure 1:
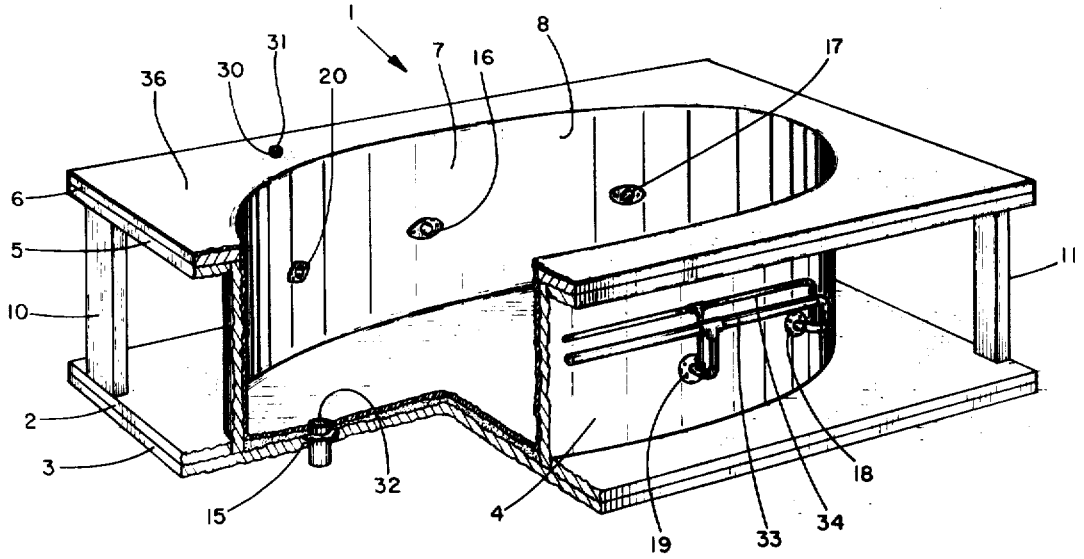
FIG. 1 is a partially sectioned perspective view of a vessel base constructed according to the invention.

Referring to FIG. 1, vessel base 1 comprises a structural plywood body coated with a fiberglass/resin mixture. Construction of the base is as follows. Base template 2 is cut from ¾" marine plywood by sawing an oval hole in the wood in the desired shape of the bathing vessel. The template is laminated to a solid rectangular base 3, also of ¾" marine plywood. Sidewalls 4 are then mounted in the template; curved portions are fabricated by bending three separate sheets of ¼" marine plywood to conform to the template (see FIG. 2). The plywood is fastened by any conventional means, such as nails, screws, or adhesive.

The upper template is the same as the lower template, but has an open top. The upper template consists of a laminate of ¾" plywood 5 having an oval opening of the same shape and size as the opening in piece 2, and an upper piece of marine plywood 6 having an opening 7 conforming to the inner wall surface 8 of the vessel. A series of 1"×4" vertical studs 10 and 11, and the like are situated around the periphery of the vessel base for strength.

Next, various bores for utilities are cut into the plywood. Drain hole 15 is cut into the base piece 3, and holes (not shown) are cut through the sides of the vessel base for mounting hydrotherapy jets 16, 17, 18, 19, and 20. A vertical bore 30 is also cut through the upper template to accomodate the air inlet control 31.

Figure 3:
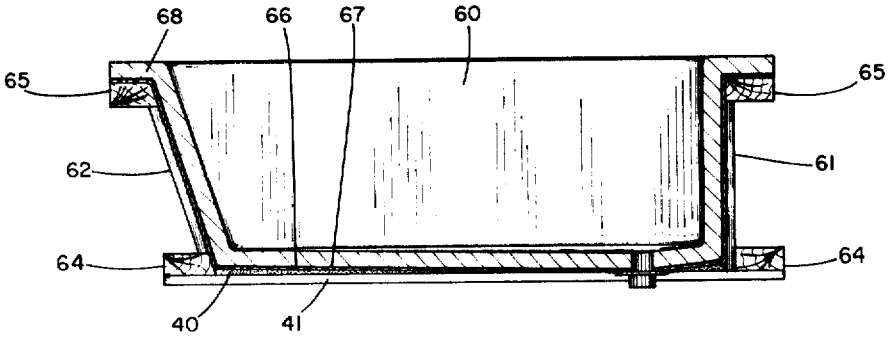
FIG. 3 is an elevational side section view of a vessel of the invention.

After the vessel base wood frame is completely constructed, the drain fixture 32 is mounted in bore 15, and the floor 35 of the tub is contoured to permit drainage of old water in the tub to the drain. This is accomplished by placing a layer of dry 30-mesh silica sand in the bottom of the tub, and shaping the sand to provide a gentle downward slope to the drain across the floor of the tub. This is best seen in FIG. 3, wherein said layer 40 has been sloped toward the drain on the floor 41 of the tub. The sand can easily be shaped by hand or with a small tool, or can be placed with a precut mold.

The next step involves application of a fiberglass/resin mixture to the inner surface (walls 8 and floor 35) of the wood frame, and to the upper surface 36 which forms a shelf around the vessel. First, a coat of liquid resin is applied; this coat wets the surface of the vessel to enable the fiberglass strands to stick to the surface, and also serves to solidify the bottom sand layer. A fiberglass/resin mixture is then applied with an applicator gun, and may be followed by another spray treatment with liquid resin. The resulting surface is then wiped with rollers similar to small paint rollers to smooth the surface and remove air bubbles. Application of the fiberglass/resin mixture is conventional, and is commonly carried out in the manufacture of fiberglass shells e.g. for hydrotherapy spas. The fiberglass and resin are applied with a "chopper gun" which can be used to apply either or both components at the same time. The fiberglass is applied in short (1½"−3") strands, and imparts great strength to the coating. The resin is a conventional thermosetting polyester resin, such as Cargill synthetic resin solution, which cures after mixing with an oxidant such as methyl ethyl ketone peroxide. The resin gels in less than ½ hour, and cures in about three days.

After the resin has cured, any necessary plumbing fixtures, such as the hydrotherapy system water and air piping 33 and 34, are attached, and the vessel base is shipped to the job site. Upon installation at the job site, the finish of the interior of the vessel is completed. The finishing process may depend on local building codes. In general, first, an additional waterproof membrane is applied; this membrane is commonly three layers of asphalt-impregnated 15-pound felt hot-mopped to the fiberglass/resin surface, but may be a lead or copper sheet.

Figure 2:
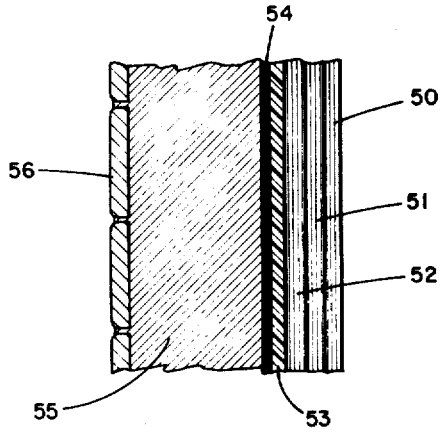
FIG. 2 is a view of a wall section of a completed vessel.

After the hot mopping process, the surface finish is applied. Typically, this finish is Terrazzo or ceramic tile in a cement mortar having a total thickness of about 2". A section view of a typical completed vessel wall is shown in FIG. 2. The exterior of the wall is formed from three layers of ¼" plywood designated as 50, 51, and 52. The fiberglass/resin layer 53 is laminated to the interior plywood section 52, and is in turn covered with hot-mopped felt layer 54. The interior of the tub is formed from grout 55 and decorative tile 56. The plywood and fiberglass/resin layers make up the vessel base, which provides the structural shape, and strength, and waterproofing of the vessel.

A cross-section of a more conventionally shaped rectangular tub is shown in FIG. 3. Side walls 60, end walls 61 and 62, and floor 41 are all fabricated from flat ¾" marine plywood. The lower template is formed from a peripheral ring of 2"×4" structural members 64; the upper template comprises a ring of 2"×4" members 65. These members are beveled to fit the slope of the tub side and end walls as necessary. The upper surface of the upper 2"×4" members serves as a ledge around the edge of the tub. The tub is shown as finished with layers of fiberglass/resin 66, hot-mopped felt 67, and grout 68.

The fabrication technique of the invention permits easy manufacture of Roman tubs of virtually any size and shape. These tubs can be basically factory constructed from specifications conforming to measurements at the installation site. Many variations are possible within the spirit and scope of the invention, which relates to a forming technique for bathing vessels which comprises making a form from structural sheet material and coating the interior of the vessel with a fiberglass/resin laminate. Various resins, for example, could be used. Accordingly, while a specific embodiment of the invention has been disclosed in detail, this description should be considered illustrative rather than limiting, and the invention should be limited only by the following claims.

I claim:

1. A method of manufacturing a custom bathing vessel which comprises, at a first manufacturing location, building a structural wood form by fabricating a generally flat wood base member and a plurality of wood wall members, attaching said base and wall members, boring holes in the form to receive utilities, mounting utility fixtures in the form, coating an interior surface of the form with a fiberglass/resin mixture, allowing said mixture to harden and adhere to the form, and shipping the vessel to a second location for installation.

2. The method of claim 1 also comprising applying a waterproof coating over said fiberglass/resin mixture.

3. The method of claim 1 also comprising applying a water-impervious decorative coating over said fiberglass/resin mixture.

4. The method of claim 1 also comprising first applying a waterproof coating over said fiberglass/resin mixture, and subsequently applying a water-impervious decorative coating over said waterproof coating.

5. The method of claim 4 wherein the waterproof coating is asphalt-impregnated felt.

6. The method of claim 4 wherein the decorative coating is ceramic tile.

7. The method of claim 4 wherein the waterproof coating is asphalt-impregnated felt, and the decorative coating is ceramic tile.

8. The method of claim 1 comprising building the wood form and applying the fiberglass/resin mixture at said first location, transferring the form to said second location, installing the form permanently in said second location, and applying a water-impervious decorative coating over said fiberglass/resin mixture at said second location.

9. The method of claim 8 also comprising applying an asphalt-impregnated felt coating over said fiberglass/resin mixture prior to applying the decorative coating.

* * * * *